US006360763B1

(12) United States Patent
Narayanan et al.

(10) Patent No.: US 6,360,763 B1
(45) Date of Patent: Mar. 26, 2002

(54) CONTROL OF FLOW SEPARATION WITH HARMONIC FORCING AND INDUCED SEPARATION

(75) Inventors: Satish Narayanan, Ellington, CT (US); Bernd R. Noack, Berlin (DE); Andrzej Banaszuk, Manchester; Alexander I. Khibnik, Glastonbury, both of CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/839,046

(22) Filed: Apr. 20, 2001

(51) Int. Cl.[7] ..... F15C 1/04

(52) U.S. Cl. ..... 137/13; 137/826; 137/833; 137/828

(58) Field of Search ..... 137/828, 826, 137/825, 827, 13

(56) References Cited

U.S. PATENT DOCUMENTS

| | | | | | |
|---|---|---|---|---|---|
| 3,680,594 | A | * | 8/1972 | Petersen | 137/625.69 |
| 4,998,553 | A | * | 3/1991 | Schram | 137/13 |
| 5,040,560 | A | * | 8/1991 | Glezer et al. | 137/13 |
| 5,111,847 | A | * | 5/1992 | Hu et al. | 137/828 |
| 5,662,136 | A | * | 9/1997 | Drzewiecki et al. | 137/14 |
| 5,797,414 | A | * | 8/1998 | Sirovich et al. | 137/13 |

* cited by examiner

*Primary Examiner*—A. Michael Chambers

(57) ABSTRACT

A diffuser (7) has a step (12) in the surface (9) just upstream of a point where boundary layer separation might occur. An acoustic jet (22) has a nozzle (17) immediately downstream of the step (12); the acoustic jet is driven (25) by a plurality of frequencies, one or more of which are subharmonics of another of them, and having different phases.

8 Claims, 4 Drawing Sheets

CONTROL OF FLOW SEPARATION WITH HARMONIC FORCING AND INDUCED SEPARATION

TECHNICAL FIELD

This invention relates to controlling the separation of boundary layer flow by means of the combination of a small protrusion just upstream of the expected separation point and dynamic forcing, through a slot at the downstream base of the protrusion, in response to harmonically and phase related forcing signals.

BACKGROUND ART

Loss of efficiency and performance as a consequence of boundary layer flow separation is known to cause retreating blade stall, drag of bluff bodies, jet engine air inlet distortion, as well as losses in diffusers, heat exchangers and pumps in heating, ventilating and air conditioning systems. Known separation controls have included passive vortex generators as well as blowing or suction in the near-wall regions where separation may occur. A recent approach that causes the boundary layer to absolutely attach to the surface is disclosed in commonly owned U.S. patent application Ser. No. 09/257,565, filed on Feb. 25, 1999, which achieves clearly superior results with significantly low levels of control energy input. However, there is a possibility that restrictions on the amount of control that can be practically provided in certain applications may render that approach less useful in those certain applications.

DISCLOSURE OF INVENTION

Objects of the present invention include provision of a flow boundary layer separation control with smaller parasitic drag, and requiring less energy than prior forcing techniques.

This invention is predicated partially on the realization that the unsteady nature of flow structures in and near a boundary layer result in motion of the separation point in an uncontrolled flow, whereby a point of receptivity to a control impetus is not well defined, nor static, which makes it difficult to position the control device correctly and thereby endangers the effectiveness of the control when any change in flow conditions may cause the separation point to migrate a functionally significant distance from the control location.

According to the present invention, the separation of a flow boundary layer is controlled by inducing a flow separation of thickness on the order of the thickness of the boundary layer, such as by means of a step or other geometrical protrusion, and an oscillatory fluid pressure jet inlet (downstream-facing) in the wall surface immediately downstream of the protrusion, the inlet providing alternating sucking and blowing in response to a combination of frequencies which include a fundamental frequency and at least one subharmonic frequency, said frequencies related by selected phase angles. In one embodiment, the jet excitation signal may take the form $$A \sin[2\pi(f/3)t]+B \sin[2\pi(f/2)t+\phi_1]+C \sin[2\pi(f/3)t+\phi_2] \qquad \text{EQN. 1}$$

Other objects, features and advantages of the present invention will become more apparent in the light of the following detailed description of exemplary embodiments thereof, as illustrated in the accompanying drawing.

MODE(s) FOR CARRYING OUT THE INVENTION

Figure 1:
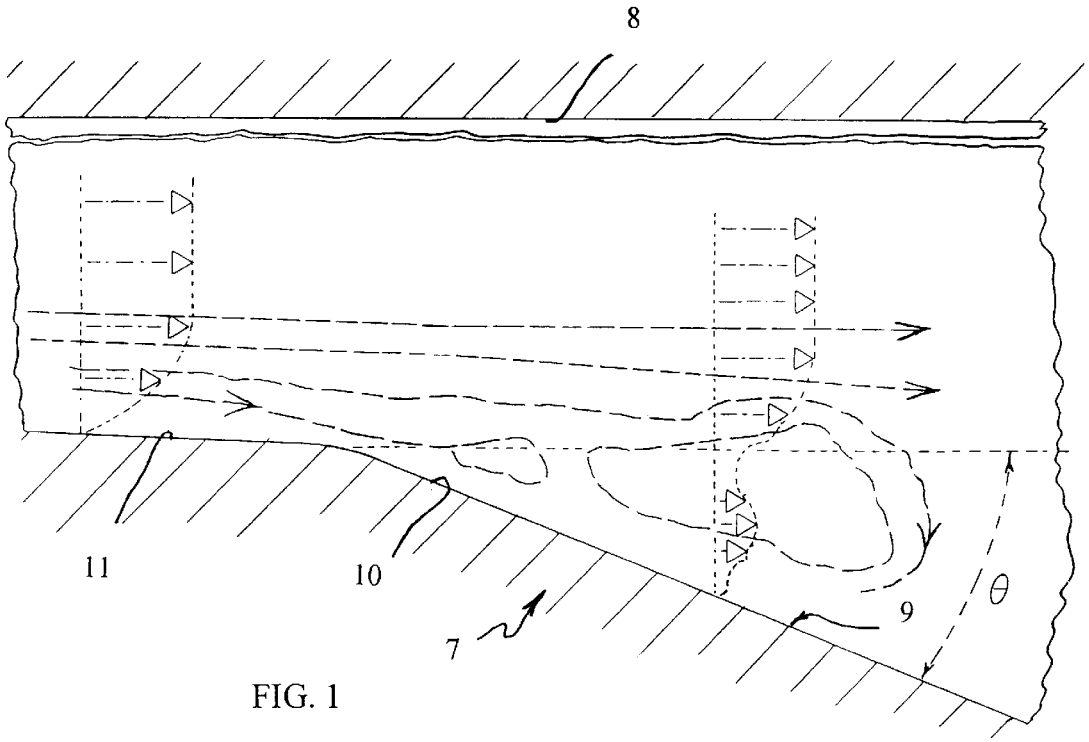
FIG. 1 PRIOR ART
FIG. 1 is a simplified side elevation illustration of a simple, reverse-ramp, diffuser, known to the prior art.

Referring to FIG. 1, a two-dimensional expansion 7 has an upper surface 8 parallel with the flow and a lower surface 9 with an expanding wall 10 at an included angle, θ, of about 23°, and a parallel wall 11. The flow, indicated by dash lines, reveals large transitory stall, involving large-scale, unsteady separation. In FIG. 1, the dot/dash arrows and the dotted lines indicate magnitude of flow velocity, but not direction.

Figure 2:
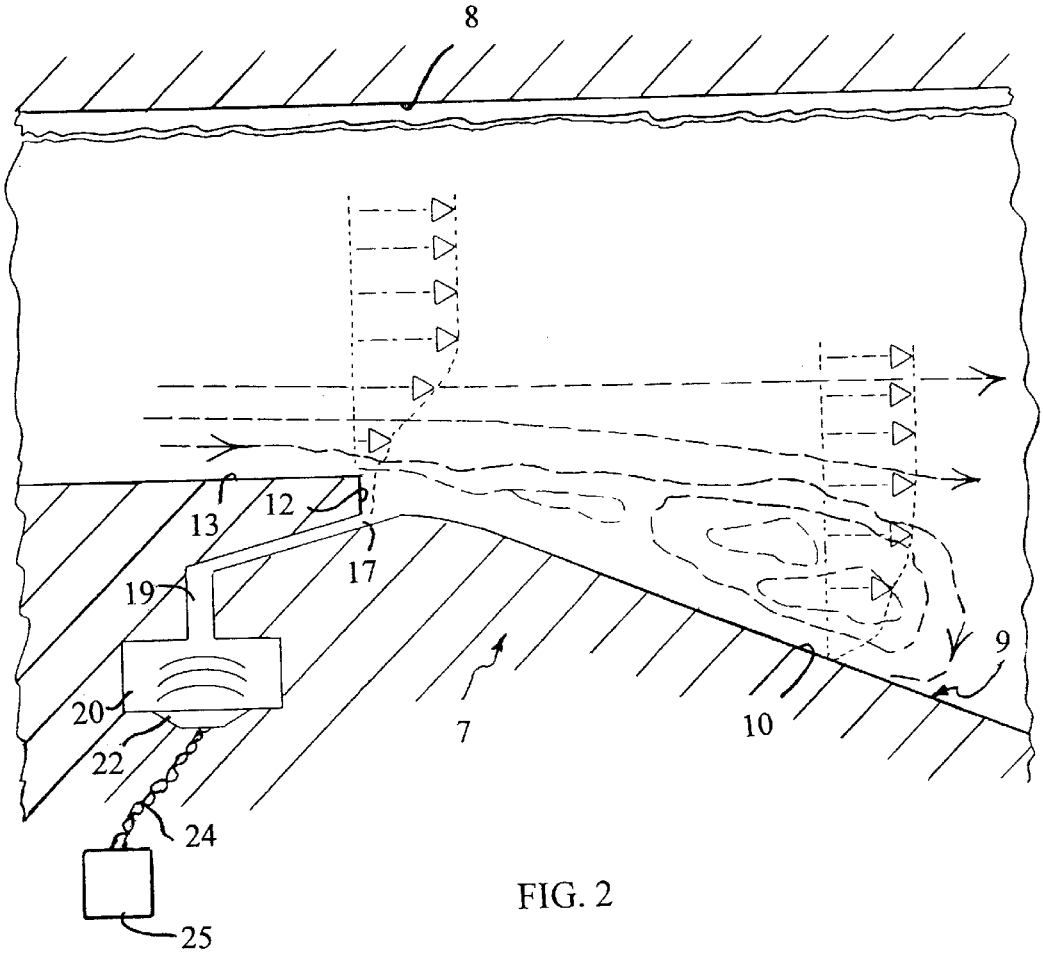
FIG. 2 is a simplified side elevation illustration of a reverse-ramp diffuser with a protrusion in the form of a step and forcing unit of the invention.

Referring to FIG. 2, in accordance with the invention, the expander surface 9 is provided a protrusion formed by a reverse step 12 between a surface 13 which is parallel to the inlet flow, and the diffuser surface 10 induces a small-scale flow separation, somewhat greater than the thickness of the boundary. At the base of the step 12 there is an inlet 17, which comprises a cross stream slot connected by means of a channel 19 to a chamber 20 to which there is attached a loudspeaker 22, to obtain an oscillatory, zero-mass flux fluid flow into and out of the main flow.

According to the invention, the loudspeaker is driven over wires 24 by a signal from a driver 25 having the form of Eqn. 1, hereinbefore, although it may have additional subharmonic terms, if desired, or only one subharmonic term, if desired.

Figure 3:
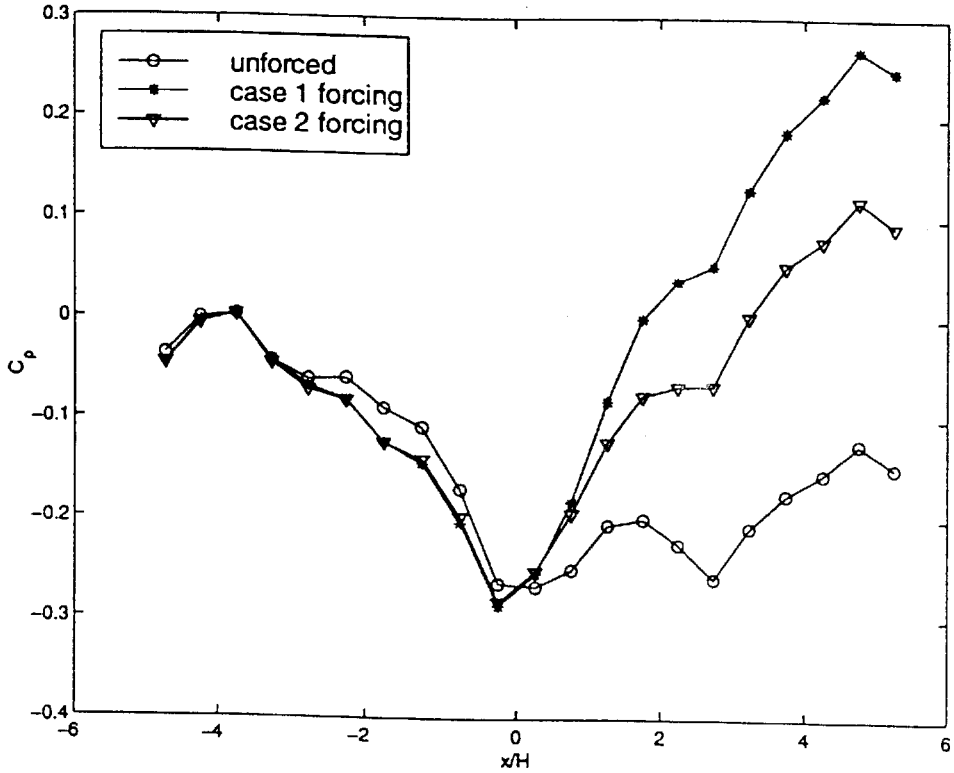
FIG. 3 is a plot of mean pressure recovery coefficient as a function of distance along a diffuser, for unforced flow and two cases of forcing in accordance with the invention.

As an example, an experimental facility having a diffuser inlet height of 5.08 centimeters, and a diffuser width (spanwise length) of 20.32 centimeters. Corresponding inlet flow velocity was in the range of 20 m/s to 40 m/s, in the Mach number range of between 0.06 and 0.12. The boundary layer thickness was about 0.3 mm and the step height was 4.0 mm. The non-dimensional expansion length, normalized by the inlet height, is determined to be four. In this example, the channel 19 is 18 cm long and 0.32 cm wide, and it transitions to the angled slot 17, which is 18 centimeters long and 0.15 centimeters wide; in the example, the slot exited at nearly 30° to the flow direction. In the example, a forcing signal applied to the loudspeaker 22 contained only the first two terms of Eqn. 1, in which A equaled B, f was 60 Hertz, and the phase angle, $\phi_1$ was chosen, in case one, to be +60°, and in case two to be −120°. In FIG. 3, the mean pressure recovery coefficient, $C_p$, is plotted as a function of distance along the diffuser, normalized by the diffuser inlet height.

The mean pressure recovery coefficient, $C_p$, is $$C_p=(p_i-p_e)/\tfrac{1}{2}\rho U^2$$

where $p_i$=inlet pressure $P_e$=exit pressure

ρ=fluid density and U is the maximum inlet velocity.

Figure 4:
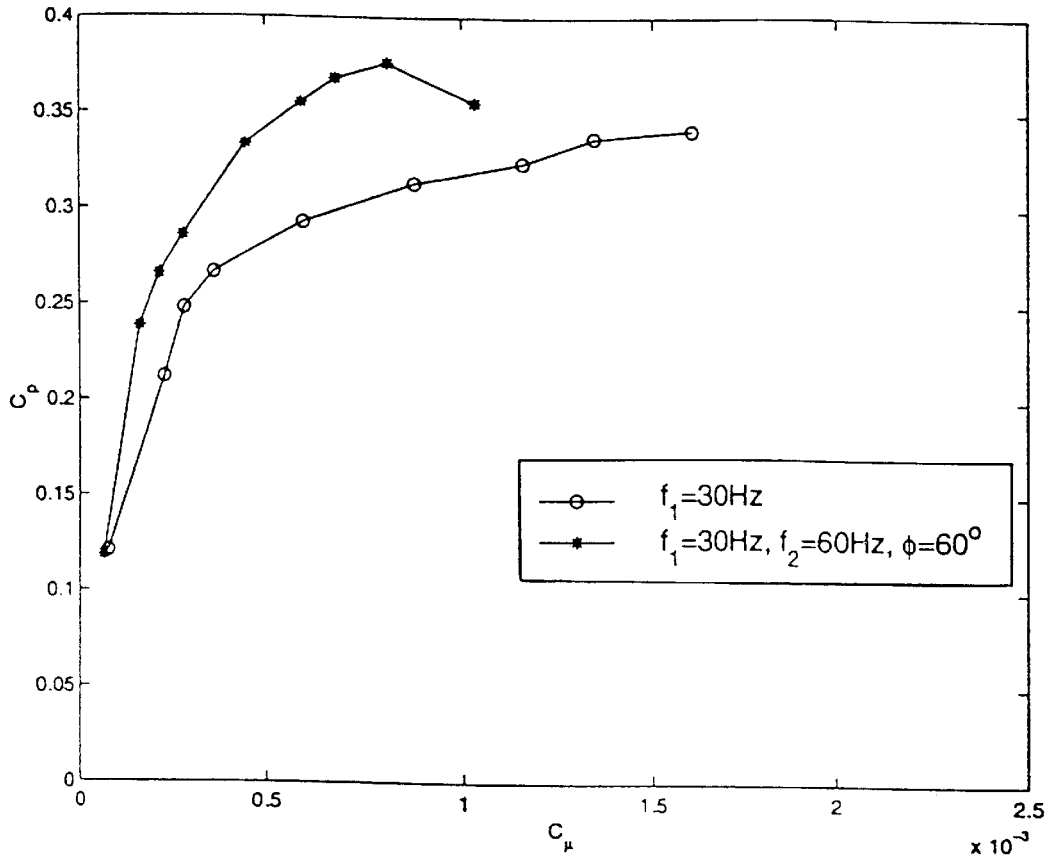
FIG. 4 is a plot of mean pressure recovery coefficient as a function of normalized momentum coefficient for single-frequency forcing of the prior art and multiple-frequency forcing of the invention.

In FIG. 3, prior to the step (at the zero point of the abscissa in FIG. 3), the mean pressure recovery coefficient is essentially the same for all three cases. However, downstream of the step (positive abscissa numbers in FIG. 3) the mean pressure recovery coefficient is very low for the case where the loudspeaker 22 is not provided any excitation so the flow is unforced. The results for case two, having a large negative phase angle, are less attractive than the results for case one having a small positive phase angle of 30°. FIG. 4 illustrates the mean pressure recovery coefficient, $C_p$, which is achievable for various values of a non-dimensional, normalized momentum coefficient $C_\mu$, for a case in which single frequency forcing is used and a case in which dual frequency forcing is used, as described hereinbefore. The non-dimensional, normalized momentum coefficient, $C_\mu$, is computed as $$C_\mu = wu_a^2/WU^2$$

where w is the actuator slot exit width

W is the diffuser inlet width and $u_a$ is the peak-to-peak amplitude of the forcing, at the location along the actuator slot exit of the maximal amplitude FIG. 4 illustrates that a given mean pressure recovery coefficient, $C_p$, can be achieved when using two frequency forcing with one-third to one-half the momentum coefficient, $C_\mu$, as is required when using single frequency forcing, with the energy saving being commensurate.

Although the invention is described as employing a step as a protrusion, to induce a flow separation, a deflected flap or other protrusion may be used. Similarly, the invention is described as implemented with an acoustic jet, using an electroacoustic transducer as a gas pressure oscillation generator; however, piezo flaps, solenoid valves and other forms of gas pressure oscillation generators may be used if desired.

The aforementioned patent application is incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of controlling flow boundary layer separation which comprises:

dynamically forcing the boundary layer in said flow just upstream of a point of normal boundary layer separation with a stream of high momentum flux particles having significant oscillatory pressure components at a plurality of frequencies, at least one of said frequencies being a subharmonic of another one of said frequencies and having a phase different from the phase of said another frequency.

2. A method according to claim 1 wherein there are two frequencies.

3. A gas flow system comprising:

a gas flow path adjacent a surface, gas flowing within said path having a boundary layer adjacent said surface; and an oscillatory jet having a chamber, a gas pressure oscillation generator for providing gas in said chamber having significant oscillatory pressure components, a gas passage interconnecting said chamber with said gas flow path, said passage directed into said flow at an acute angle with respect to said surface, to provide high momentum flux gas particles into said boundary layer;

characterized by the improvement comprising:

means for driving said gas pressure oscillation generator with a plurality of frequencies, at least one of said frequencies being a subharmonic of another of said frequencies and having a phase difference with respect to the phase of said another frequency.

4. A system according to claim 3 wherein:

said gas pressure oscillation generator is electroacoustic.

5. A system according to claim 3 further comprising:

a protrusion extending from said surface which is larger than the thickness of said boundary layer to define a point along said flow path where the effectiveness of said high momentum flux particles will be maximal, said step being immediately upstream of said gas passage.

6. A system according to claim 5 wherein:

said protrusion is a step in said surface.

7. a system according to claim 3 wherein said gas pressure oscillation generator is driven by two frequencies.

8. A method of operating a gas flow system having a gas flow path adjacent a surface, gas flowing within said path having a boundary layer adjacent said surface, and an oscillatory jet having a chamber, a gas pressure oscillation generator for providing gas in said chamber having significant oscillatory pressure components, a gas passage interconnecting said chamber with said gas flow path, said passage directed into said flow at an acute angle with respect to said surface, to provide high momentum flux gas particles into said boundary layer, said method comprising:

driving said gas pressure oscillation generator with a plurality of frequencies, at least one of said frequencies being a subharmonic of another of said frequencies and having a phase difference with respect to the phase of said another frequency.

* * * * *